United States Patent [19]

Portnoff

[11] 4,277,890

[45] Jul. 14, 1981

[54] DEVICE FOR CUTTING MULTIPLE PLIES OF MATERIAL

[76] Inventor: Lawrence A. Portnoff, 818 Olive St. #22, St. Louis, Mo. 63101

[21] Appl. No.: 99,912

[22] Filed: Dec. 3, 1979

Related U.S. Application Data

[63] Continuation-in-part of Ser. No. 891,631, Mar. 30, 1978, abandoned.

[51] Int. Cl.[3] ..... B26B 7/00

[52] U.S. Cl. ..... 30/273; 83/925 CC

[58] Field of Search ..... 30/273, 275; 83/56, 83/925 CC, 781

[56] References Cited

U.S. PATENT DOCUMENTS

| | | | |
|---|---|---|---|
| 1,164,669 | 12/1915 | Steinman | 30/273 |
| 2,080,328 | 5/1937 | Meyer | 30/273 X |
| 2,305,465 | 12/1942 | Bangser | 30/273 |
| 3,747,454 | 7/1973 | Gerber | 83/925 CC X |
| 3,830,122 | 7/1974 | Pearl | 83/925CCX |

*Primary Examiner*—Frank T. Yost

*Attorney, Agent, or Firm*—Jon M. Lewis

[57] ABSTRACT

An oscillating knife in a textile cutting machine is inclined to cut multiple plies of material generally substantially 90 degrees to each ply by inclining the cutting machine or a knife blade.

4 Claims, 5 Drawing Figures

DEVICE FOR CUTTING MULTIPLE PLIES OF MATERIAL

This is a continuation in part of my patent application Ser. No. 891,631 filed Mar. 30, 1978, for "METHOD AND DEVICE FOR CUTTING MULTIPLE PLIES OF MATERIAL", now abandoned.

BACKGROUND OF INVENTION

1. Field of Invention

This invention relates to the clothes manufacturing industry where patterns are followed to cut textile material in many pieces which are fit together and sewn to product clothing as finished product. It more particularly relates to cutting multiple plies, of material by following a pattern with a cutting machine having an oscillating knife. The knife oscillates vertically as it is pushed along the pattern to cut the pattern and the material underneath.

2. Description of Prior Art

Cutting machinery for cutting multiple plies of material according to a pattern has been known and used since the mass production to clothing started. Generally an oscillating knife is used to cut the plies of material according to a pattern. The pattern is placed on top of multiple plies of textile material. The knife is pushed along the pattern, thereby cutting the material.

Due to the design of the present cutting machinery, the top ply being cut is not the same size as the bottom ply. This happens even though the worker is careful in following the pattern exactly. The leading edge of the machine base distorts the cloth plies when cut so that it always is angled away from the presently known vertical knife. The size of the top ply may vary as much as $\frac{1}{4}$ inch to $\frac{3}{8}$ inch from the bottom ply after the cut. The material angles away from vertical when the leading edge of the cutting machine is placed under the material when moved into position to start cutting.

None of the prior art methods of cutting material or cutting machines incline the knife so that the knife is relatively 90 degrees to each ply during the actual cutting operation. Inclining the knife, as taught by my invention, permits the top, bottom and middle plies being cut to be closer in size than that which was heretofore known in the prior art.

Quality control is thus greatly enhanced over the prior art in order to permit relatively more uniform sizing of finished goods.

SUMMARY OF INVENTION

My invention discloses a novel and useful method and device for cutting multiple plies of material. An oscillating knife of a cutting machine is inclined towards each ply of the multiple plies of material while being cut. Means for inclining the oscillating knife may include angling the base and knife together so that the knife is relatively perpendicular to the cloth. The means may also include inclining a stand, or the knife blade itself. By inclining the knife cutting edge relatively 90 degrees to each ply, each ply is cut more exactly in size than was heretofore known in the art.

The inclined knife eliminates the age old problem of the top piece of material possibly being one-quarter of an inch to three-eighths of an inch different in size than the bottom piece when numerous plies of material are cut according to a pattern. While being cut, the material shifts between plies as the base pushes under it which causes the problem. Inclining the knife towards the angle caused by shifting plies, the cutting edge provides for a more true to size cut and tends to minimize distortion.

The more true the sizing cut, the greater quality control is achieved in the production as well as in the uniform sizing of finished garments.

DESCRIPTION OF THE PREFERRED EMBODIMENT

Figure 1:
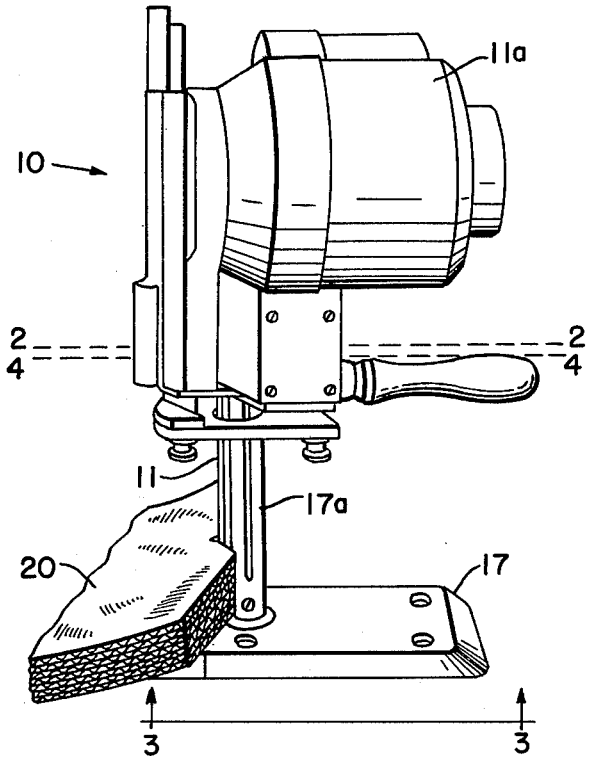
FIG. 1 is a perspective elevational view of one embodiment of my invention.

Referring to the drawings, FIG. 1 discloses a cutting machine 10 illustrating the teachings of my invention. In the cutting machine 10 an oscilatting knife 11 is attached to the cutting machine 10. As the oscillating knife 11 moves up and down, it cuts the plies of material 20.

Figure 2:
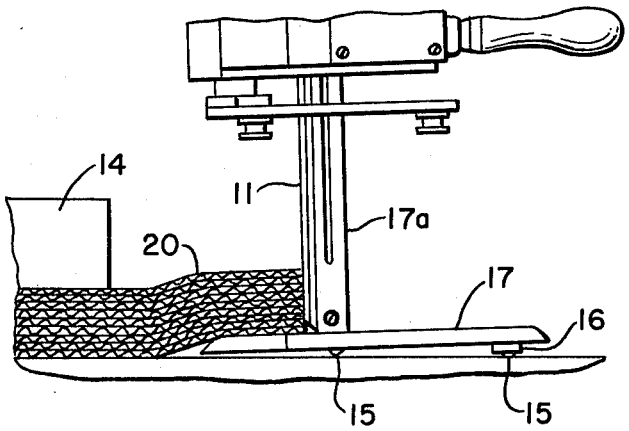
FIG. 2 is a partial broken away sectional view taken along Line 2—2 of FIG. 1.

Referring to FIG. 2, means for inclining the oscillating knife 12 in the form of a shim member 16 inclines the knife 11 with respect to a vertical line so that the knife 11 cuts the plies substantially at 90 degrees to each ply 20. Said shim 12 is attached to the cutting machine 10 to raise the under base and incline a column **17*a* with the knife 11 and its motor 11*a*** attached therefrom.

Figure 3:
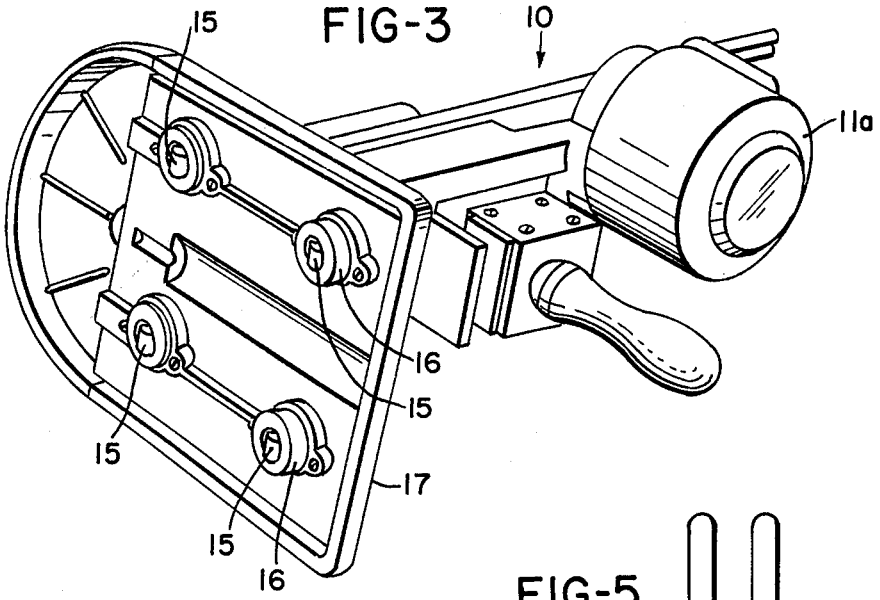
FIG. 3 is a sectional view taken along Line 3—3 of FIG. 1.

Referring to FIG. 3, in this embodiment the rollers 15 are shown, as in many conventional cutting machines, such as to facilitate free movement of the cutting machine 10 about a table. Means for inclining the oscillating knife comprises in the preferred embodiment shim member 16 placed under the base 17 to incline the oscillating knife 11. The shim member 16 inclines the cutting machine 10 in this embodiment along with the oscillating knife 11. Alternatively, the column **17*a* may be inclined with respect to the base 17**.

Referring to FIG. 2 in operation, bale 14 is placed upon the plies of material 20 in order to hold them firm. When the bale hits the material, it compresses it at an angle other than horizontal. The means for inclining the oscillating knife 11, such as the shim 16, inclines the oscillating knife 11 so that it remains relatively perpendicular to each ply. As the inclined oscillating knife 11 cuts the plies of material 20, the cuts are made relatively 90 degrees to the extended substantially flat surface of each ply. Thus, each piece is cut truer to size than what was previously known in the prior art.

Figure 4:
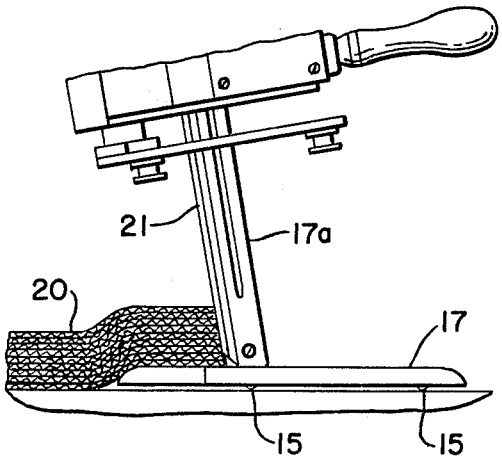
FIG. 4 is a partial sectional view taken along Line 1—1 of FIG. 1 disclosing another embodiment of the present invention with an inclined stand.

Another embodiment is disclosed in FIG. 4 which includes an inclined column **17*a*. The column 17*a* is inclined so that oscillating knife 21 cuts the plies of material 20** at substantially relatively 90 degrees to the extended surface of each ply of cloth.

In the above embodiment, it is important to this invention that the means for inclining 16 and the juncture of the base 17 and column **17*a* incline the oscillating knife 11 or 21** at an angle of 11 degrees plus or minus 4 degrees from vertical. It has been found that this angle is necessary so that each ply of material is cut at an angle relatively perpendicular to the surface of the ply.

Figure 5:
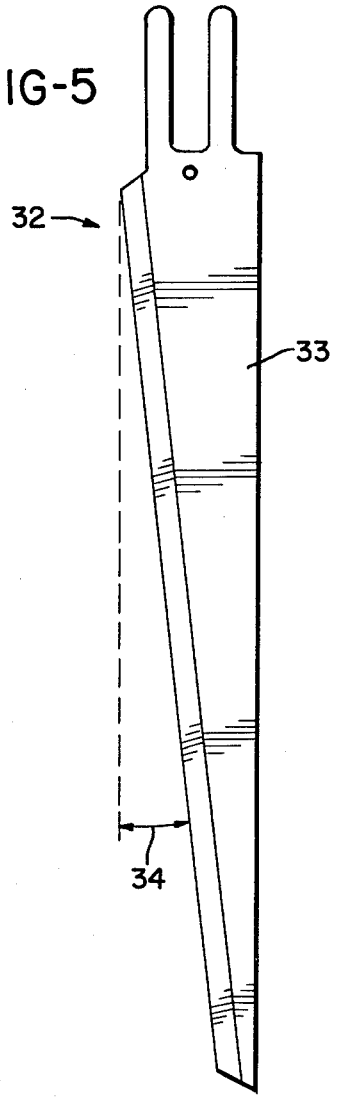
FIG. 5 is a view of another embodiment of the present invention showing a novel knife blade.

A still further embodiment in FIG. 5. Means for inclining the oscillating knife 32 includes knife blade 33 designed with an acute angle 34 of 11 degrees plus or minus 4 degrees from vertical so that when the knife blade 33 oscillates in the cutting machine 10 the plies of cloth 20 are cut relatively perpendicular to each ply of material.

As it may readily appear to those skilled in the art, various changes may be made in relative locations and arrangements of the several parts without departing from the sphere and scope of this invention. It is not meant to limit the invention except by the following claims:

I claim:

1. A device for cutting multiple plies of cloth having extended substantially flat surfaces; said devise comprising a base for being placed on a substantially horizontal surface;

a column attached to said base, means for oscillating a knife for cutting said cloth, said oscillating means being attached to said column;

a knife having an edge for cutting said cloth attached to said oscillating means; and means for inclining said edge of said knife with respect to a vertical axis with respect to said substantially horizontal surface at such an angle whereby said knife edge, in operation, cuts the said multiple plies of cloth at an angle of substantially 90 degrees to the extended surface of each ply.

2. The device of claim 1 wherein said inclining means comprises:

at least one shim member attached to a base of the cutting machine, to incline the oscillating knife.

3. The device of claim 1 wherein said inclining means comprises:

a juncture of said column and said base at a predetermined acute angle less than 90 degrees.

4. The device of claim 1 wherein said inclining means comprises:

an edge of said knife blade that deviates from a vertical axis so that the cutting edge of the knife blade is substantially perpendicular to each ply of material.

* * * * *